US005166575A

United States Patent [19]

Gerlach

[11] Patent Number: 5,166,575

[45] Date of Patent: Nov. 24, 1992

[54] GRID TUBE WITH COUPLED-CAVITY OUTPUT, WITH COUPLING ELEMENT INTEGRAL WITH SAID TUBE

[75] Inventor: Pierre Gerlach, Thonon les Bains, France

[73] Assignee: Thomson Tubes Electroniques, Boulogne Billancourt, France

[21] Appl. No.: 547,501

[22] Filed: Jul. 2, 1990

[30] Foreign Application Priority Data

Jul. 4, 1989 [FR] France ..... 89 08966

[51] Int. Cl.[5] ..... H01J 21/10

[52] U.S. Cl. ..... 313/294; 313/293; 313/247; 313/250; 313/257; 315/5.39; 315/39.53

[58] Field of Search ..... 313/293, 294, 246, 247, 313/250, 257; 315/5.37, 5.38, 5.39, 39.51, 39.53

[56] References Cited

U.S. PATENT DOCUMENTS 3,327,156 6/1967 Geralch ..... 313/250
3,337,933 8/1967 Seiffarth et al. ..... 313/250 X
3,742,292 6/1973 Geralch ..... 315/39
4,295,077 10/1981 Carter et al. ..... 313/293
4,456,851 6/1984 Tomcavage ..... 313/250
4,639,633 1/1987 Hoet et al. ..... 313/39 X

FOREIGN PATENT DOCUMENTS 0557278 7/1987 European Pat. Off. .
2298184 8/1976 France .
2351492 12/1977 France .
2517117 5/1983 France .

*Primary Examiner*—Donald J. Yusko
*Assistant Examiner*—Ashok Patel
*Attorney, Agent, or Firm*—Roland Plottel

[57] ABSTRACT

To increase the frequency without restricting the power and vice versa, of vacuum tubes such as triodes and tetrodes for high-frequency amplification, especially for radio and television broadcasting designers are often limited by the relatively high output capacitance between the anode and the grid of the tube. To reduce this capacitance, especially when the tube is in a circuit for extracting energy from coupled cavities, the cavity coupling is integrated into the tube itself.

9 Claims, 7 Drawing Sheets

FIG_1 PRIOR ART
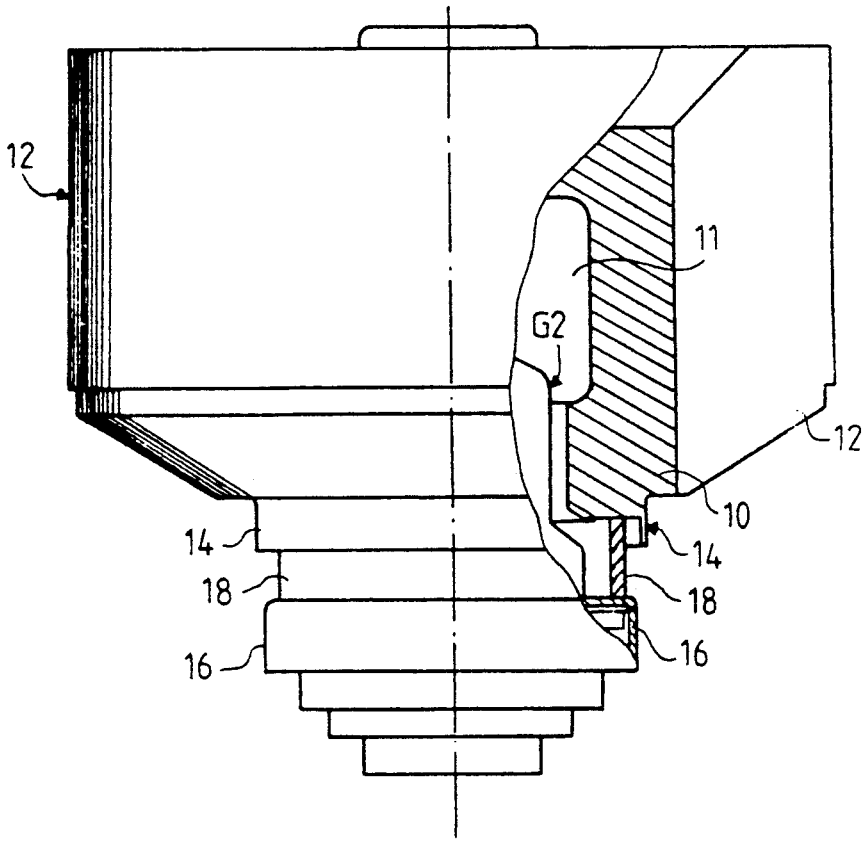
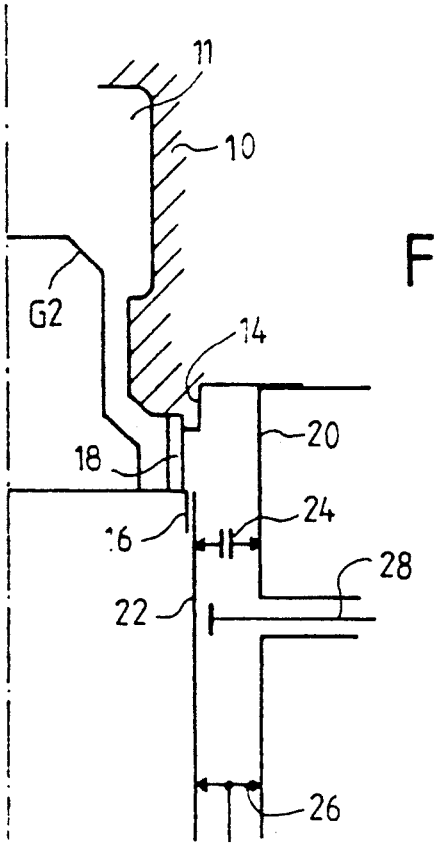
FIG_2 PRIOR ART

GRID TUBE WITH COUPLED-CAVITY OUTPUT, WITH COUPLING ELEMENT INTEGRAL WITH SAID TUBE

BACKGROUND OF THE INVENTION

The invention relates to vacuum tubes, more specifically grid amplifier tubes, such as triodes and especially tetrodes.

The invention relates particularly to grid tubes operating at high frequencies (several tens to several hundreds of megahertz) and with a power output through a coupled-cavity structure. The primary application of these tubes is radiowave transmission for radio and television in bands extending up to approximately 1,000 megahertz and for powers of several kilowatts to several tens of kilowatts.

The vacuum tube and the coupled cavities on which it is mounted form two mechanically separate assemblies that are combined to make them function. The tube is the amplifier element, whose main component is hermetically sealed in a chamber that has been evacuated. The coupled cavities form a mechanical structure separate from the tube on which the tube is mounted; they are not in a vacuum chamber; they operate in the open air; they extract high-frequency energy and transmit it through waveguides or coaxial cables, for example to a transmitting antenna, amplified by the tube.

However, the operations of the tube and coupled cavities are not independent of each other. In order to function, the coupled cavities must be tuned to a working frequency.

Therefore, there is a primary resonant circuit, a secondary circuit resonating at the same frequency, and a coupling means between the two. The primary resonant circuit is not completely enclosed in the coupled-cavity structure; it is partly contained in this structure but also partly contained in the vacuum tube itself; in other words, the resonant cavity of the primary circuit includes the entire area of the vacuum tube in which the high-frequency power energy is generated, and a portion of the coupled-cavity structure.

Specifically, in a tetrode connected in a coupled-cavity output circuit, the entire space between the anode and the control grid (usually called grid G2) forms an integral part of the primary resonant circuit, and it is clearly necessary to take this part into account when defining the composition of the coupled-cavity structure.

FIG. 1 shows a typical design of a grid tube (tetrode) designed to be connected in a coupled-cavity output circuit. The tetrode is shown partially cut away. The coupled-cavity output circuit is not shown in this figure.

The tube comprises an anode 10, a hollow cylindrical copper block whose interior wall partially delimits vacuum chamber 11 o the tube. This block is classically provided with peripheral fins 12 serving as radiators to cool the tube, or the outside wall of the anode is cooled by circulating water through a suitable jacket. A contact connection on anode 14 designed to provide contact with the coupled-cavity output circuit is formed by a flange mounted at the bottom of anode block 10. The general structure of the tube is generated by revolution around the central axis.

The control grid is shown is reference G2 in FIG. 1. It can be connected to the output circuit by a control grid connection 16, here composed of a flange coaxial with the contact flange of anode 14.

There can be a potential difference of several thousand volts between the anode and the control grid. It is therefore necessary to insulate the two flanges 14 and 16 electrically from one another. This insulation is provided by a ceramic strut 18 to which the flanges of anode 14 and control grid 16 are both soldered.

Ceramic strut 18 in this example is in the shape of a cylinder coaxial with connecting flanges 14 and 16.

It provides electrical insulation between the anode and the control grid for several thousands of volts; but it must also provide a perfect vacuum seal for chamber 11; it also provides a mechanical holding function for the parts of the tube (rigid connection between anode and grid); finally, it can also act as a dielectric window to allow the high-frequency energy to pass to the output circuit.

It is not necessary to describe the rest of the tube, especially the other electrodes, which are of classic design. The invention relates to the high-frequency output of the tube; in this type of tube, the output is between the anode and the control grid.

FIG. 2 is a highly schematic representation of the same tube, but this time connected to its coupled-cavity output circuit.

The coupled-cavity assembly comprises a coaxial conducting structure having a first wall 20 in electrical contact with anode 10 and a second wall 22 in contact with the connecting flange of grid 16. This structure defines two resonant circuits separated by an electromagnetic coupling means 24. In this example, coupling means 24 is a capacitive piston, free to move between the walls of the coupled-cavity structure. The piston can be fixed if the tube is to operate on a single frequency; it is movable to allow tuning to a desired frequency, within a range of adjustment related to the distance the piston can be displaced; piston 24 in fact defines the downstream end of the first structure of the cavity.

The primary resonant circuit, designed to transmit high-frequency energy to the secondary circuit through coupling means 24, comprises not only the zone above the coupling piston between walls 20 and 22 of the coupled-cavity structure, but also the entire zone inside the tube, between the control grid and the anode, where the high-frequency fields are developed when the tube operates as an amplifier.

Resonant tuning of this primary circuit therefore involves this entire zone, which is part of the vacuum chamber of the tube but not of the coupled-cavity structure, the latter being in the open air.

The secondary resonant circuit comprises the entire zone located below coupling capacitive piston 24 between walls 20 and 22 of the structure, and extending as far as a conducting piston 26 which is free to move between the walls to adjust the resonant frequency of the circuit; capacitive coupling piston 24 defines the upstream end of the second cavity; conducting piston 26 defines the downstream end, short-circuiting the second resonant cavity.

An electromagnetic coupling means 28 is provided in the secondary circuit to tap the high-frequency energy from the secondary circuit and to transmit it to a consumer circuit, not shown, for example through waveguides or coaxial cables.

In general, the primary circuit is tuned in the quarter-wavelength mode (lambda/4); in other words, the electrical length between the tip of the anode where the strongest fields develop and the coupling piston 24 corresponds to a quarter of the wavelength at the tuning frequency. Secondary circuit tuning is in the half-wavelength mode (lambda/2) corresponding to half the length of the electrical wave between pistons 24 and 26.

The high-frequency energy passes through ceramic strut 18 constituting a high-frequency, vacuum-tight dielectric window.

But this window has a considerable surface for reasons related to the high-voltage insulation it must provide between the anode and grid. It is generally made of alumina, with a very high dielectric constant (epsilon) (nine times that of vacuum).

Therefore this ceramic has a considerable capacitance. This capacitance can reach for example 3.5 picofarads for a 10-kilowatt tube operating at about 800 megahertz, while the total output capacitance of the tube, measured between the control grid and the anode, is on the order of 13 picofarads.

The influence of this capacitance is therefore very great; it is inconvenient because the lowest possible output capacitance is desired; the Q important for the tube is its gain x passband product, and this product is practically inversely proportional to the output capacitance.

The disadvantageous influence of ceramic window 18 is apparent, when we consider that this ceramic is located near to the space (under vacuum) between grid and anode, i.e. the where there are powerful electrical fields when the tube is operated as an amplifier. The ceramic window occupies an electrical length in this space that increases directly with its dielectric constant; this increases the electrical dimensions of the resonant cavity of the primary circuit, thus reducing the maximum operating frequency.

To reduce this output capacitance, it has been suggested that the alumina window be replaced by a beryllium oxide window with a lower dielectric constant, but this material is expensive and toxic, and is therefore undesirable.

SUMMARY OF THE INVENTION

To reduce the output capacitance of a tube to be used in a coupled-cavity output circuit, the invention proposes making the coupled-cavity coupling means as an integral part of the vacuum tube, in the immediate vicinity of the evacuated space between the anode and the grid, instead of transferring it to the coupled-cavity output circuit outside the tube.

In other words, instead of providing a vacuum tube and a coupled-cavity circuit with a coupling means in the usual manner, the invention proposes providing a vacuum tube with coupling means to couple the coupled cavities, and with a coupled-cavity structure devoid of coupling means. Then, of course, the coupling means will no longer be in the same location; in an embodiment like that shown in FIGS. 1 and 2, for example, it will not be in the form of a piston movable between two coaxial walls. It must necessarily be designed otherwise.

The coupling means itself can serve to make the tube vacuum-tight in the location where it is situated.

Specifically, the coupling means can be a capacitance composed of a disk or a cylinder which is dielectric and made of alumina soldered to the metal parts, said dielectric, metal parts, and soldered connections ensuring vacuum tightness of the tube container.

The coupling means can completely replace ceramic strut 18 as shown in FIG. 1, and has the dual purpose of serving as an electrical insulator and a vacuum-tight window that is transparent to high-frequency energy. However, it can also be provided in addition to this window, especially when it is desired to provide frequency tuning of the primary circuit by the outside of the tube. In this case, however, although the ceramic window is designed as shown in FIG. 1 and is always present, it becomes much more undesirable because it can be located further from the interaction space between the grid and the anode, beyond the coupling means, in an area of weak electrical fields where its influence on the total output capacitance of the tube is much weaker. In the prior art, the ceramic window was always located upstream of the coupling means since the latter was part of the coupled-cavity structure and not of the tube.

The capacitive coupling means will generally consist of a dielectric composed of a flat annular alumina disk coaxial with the anode and grid connections. It could also be composed of a tubular alumina ring with a cylindrical wall.

The coupling means can also very well be of the inductive type (coupling by the magnetic field). In this case it can be composed of a conducting cylinder pierced by small eyes distributed radially all around the cylinder, said eyes containing the ceramic windows providing vacuum tightness between the interior and exterior of the tube.

In one preferred embodiment, the tube comprises a cylindrical anode connection flange, allowing the anode to be connected with an outside wall of the coupled-cavity structure, with a flat ceramic ring constituting the dielectric of the capacitance of the coupling means; the ring is soldered by its flat faces both to this anode connecting flange and to an intermediate conducting flange that is cylindrical and coaxial with respect to the dielectric ring, permitting connection to an intermediate wall of the coupled-cavity structure; a cylindrical flange for connecting the grid, said flange permitting the grid to be connected to an inside wall of the coupled-cavity structure [and]a dielectric window between the grid connecting flange and the intermediate flange. By design this window is located further from the interaction space between the anode and the grid than is the coupling capacitance; it is in a weaker field zone and has almost no effect on the value of the total output capacitance of the tube.

Other characteristics and advantages of the invention will be apparent from reading the following detailed description referring to the attached drawings, wherein:

BRIEF DESCRIPTION OF THE DRAWINGS

FIGS. 1 and 2, above, represent a classic grid tube and a circuit for connecting said tube to a coupledcavity structure;

FIG. 3 is an enlarged view of a detail of FIG. 3;

In these figures the same references as in FIG. 1 have been used for elements with the same functions and the same references designate the same elements.

DESCRIPTION OF THE PREFERRED EMBODIMENTS

Figure 3A:
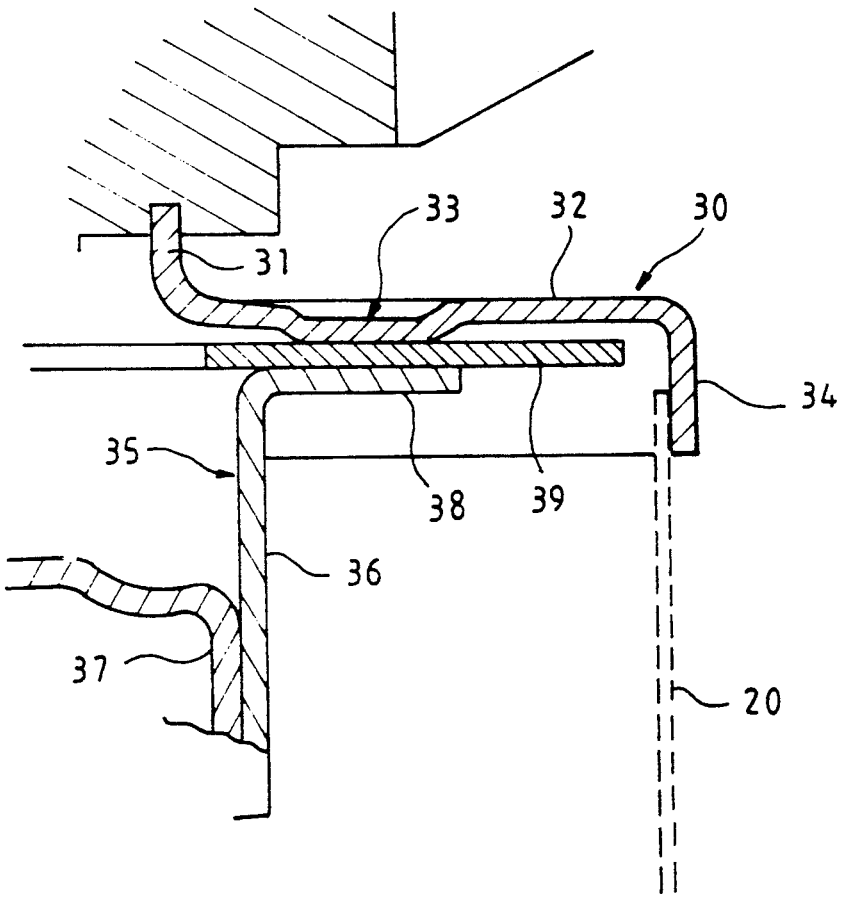
FIG. 3 shows a first embodiment of the invention, valid for a fixed operating frequency.
Figure 3:
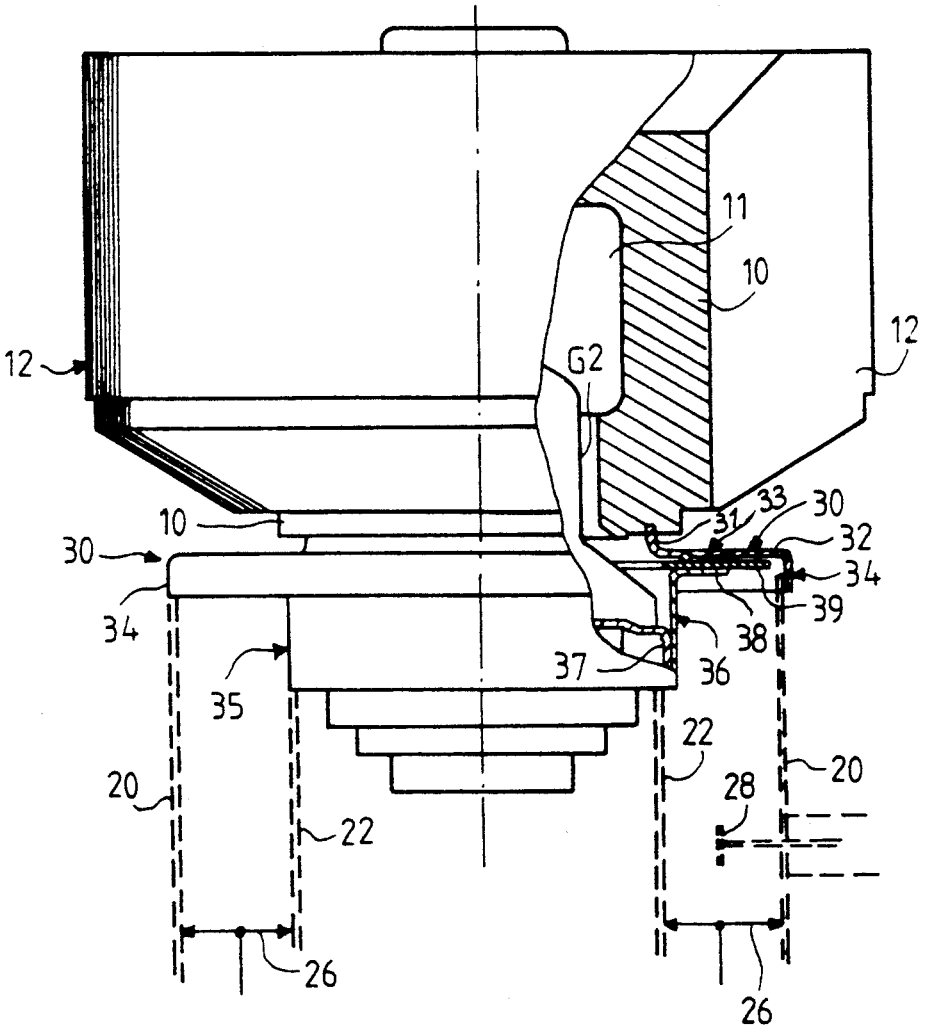

FIG. 3 shows the cylindrical block of anode 10 with its cooling fins 12, vacuum chamber 11 wherein the electronic interaction occurs that leads to amplification of highfrequency energy, and control grid G2.

An anode connection is formed by a metal part 30 of revolution, coaxial with the general axis of the tube; this part is made of a conducting alloy such as kovar that can be soldered to both copper and alumina; part 30 is mounted vacuum-tight to anode block 10, for example by having one end 31 soldered to the base of this block; part 30 comprises an annular part 32 extending essentially in a plane transverse to the tube axis; this annular part 22 comprises a projection 33 extending downward, i.e. toward the connection of grid G2 described below; part 30 is also recurved at its other end to form a cylindrical wall 34 parallel to the tube axis; this wall defines the external periphery of the anode connection and is designed to come in contact with an external conducting wall of the coupled-cavity coaxial structure indicated by the dashed lines.

The grid connection is formed by another metal part 35, also made of a conducting alloy that can be soldered to both copper and alumina. This part comprises a cylindrical part 36 soldered to a part 37 supporting grid G2; it also comprises a flat annular part 38 opposite projection 33 on the anode connection.

Part 37 supporting the grid is designed to come in contact with an internal conducting wall of a coupled-cavity structure.

A flat dielectric ring 39 preferably made of alumina is soldered by its flat faces between the anode connection and the grid connection, more specifically between projection 33 and flat annular part 38 of the grid connection. This ring constitutes the dielectric of a coupling capacitance integrated in the vacuum tube and serving as coupling means between the two resonant circuits of the coupled-cavity structure on which the tube is mounted. This coupling capacitance is located very close to the electronic interaction space between the grid and the anode; to all intents and purposes, it occupies the position of sealing window 18 in FIG. 1. The coupling capacitance itself ensures local vacuum tightness.

In the embodiment shown in FIG. 3, the tube is designed to operate at a single frequency; there is no provision for regulating the frequency; the tuning frequency is determined by the vacuum tube characteristics since the primary resonant circuit inside the vacuum tube is composed exclusively of the space extending between the anode, the grid, and the coupling capacitance integrated with the tube.

The tube is therefore mounted on a coupled-cavity structure, here comprising only a secondary circuit; this structure is coaxial and comprises two walls 20 and 22, said walls coming in contact with the cylindrical wall 34 of the anode connection and with supporting part 37 of the grid, respectively. A short-circuit piston 26 closes the secondary circuit cavity, and a coupling means 28 is provided to extract the energy from this cavity and transport it to the exterior. Piston 26 is movable to tune the resonance of the secondary circuit to the resonant frequency of the primary circuit composed of the tube.

It will be noted that dielectric ring 39 has a relatively limited thickness (on the order of 1 mm); the width of projection 33 defining the width over which this ring is soldered, can be several mm to ensure sufficient coupling capacitance. But the ring itself has a greater width (several centimeters) to ensure sufficient voltage strength under flashover conditions between metal parts 38 and 30, one of said parts being connected to the grid and the other to the anode. Cylindrical periphery 34 of the anode connection projects outside, beyond dielectric ring 39.

Figure 4A:
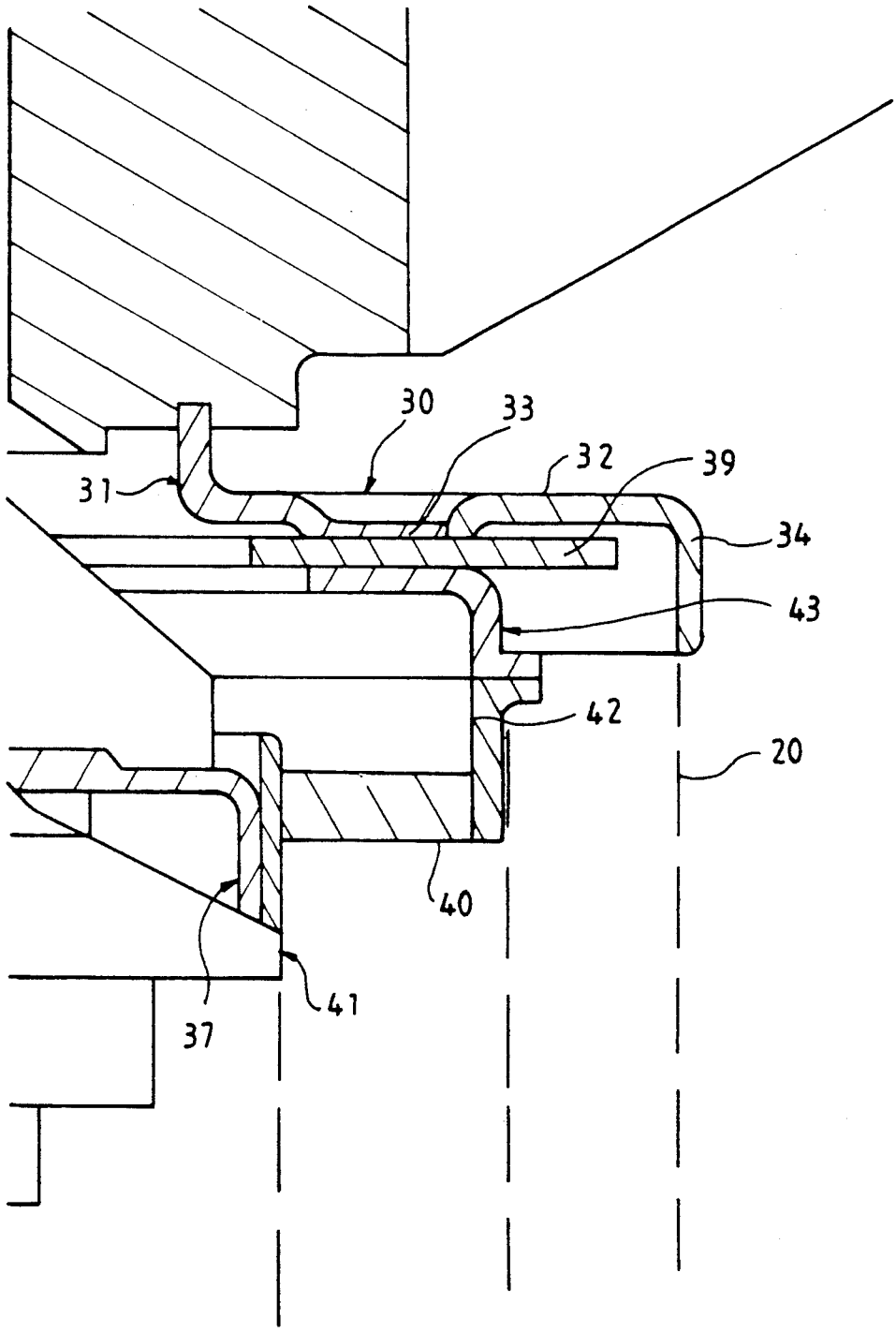
FIG. 4*a* is an enlarged view of a detail of FIG. 4.
Figure 4:
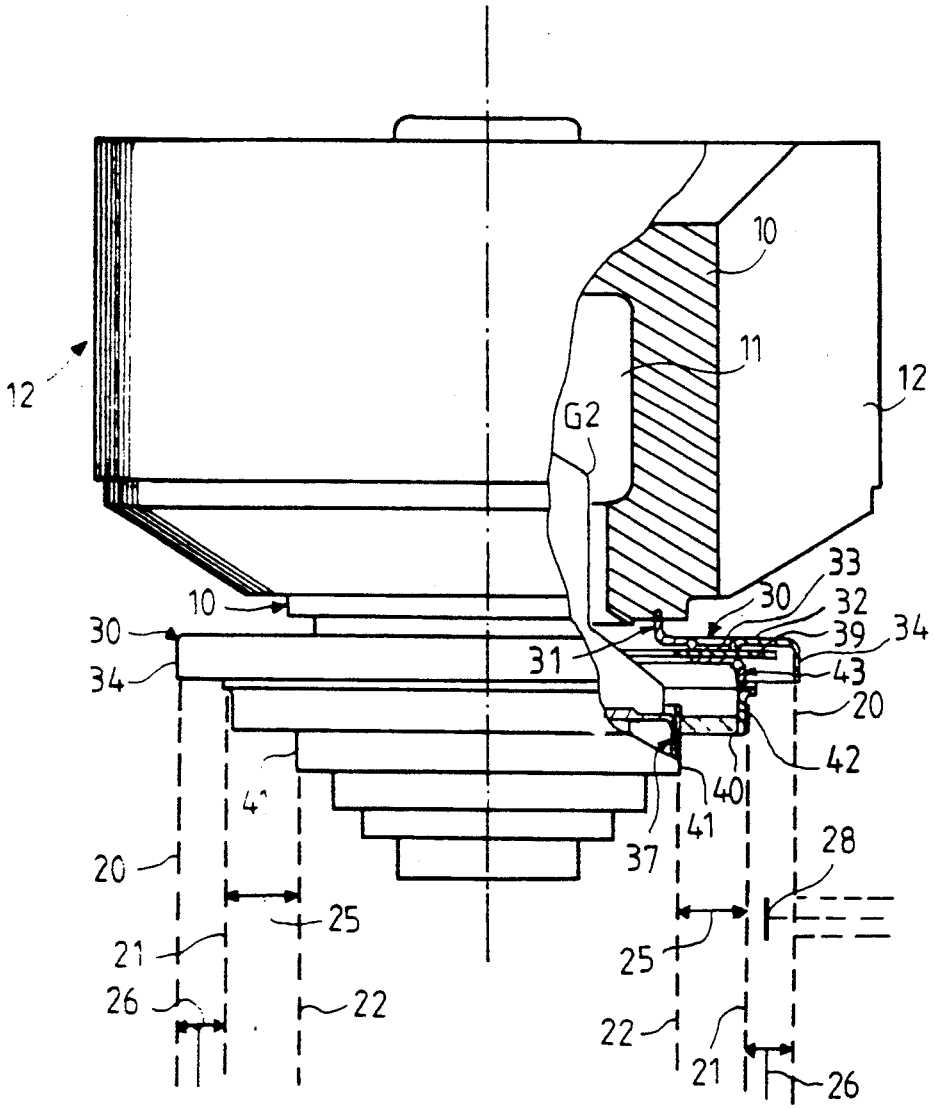
FIG. 4 shows a second embodiment of the invention usable over a range of frequencies.

FIG. 4 shows a tube according to the invention adapted to variable frequency operation. This embodiment takes its inspiration from the general structure of FIG. 3 and the same references will therefore be used for similar elements.

The difference between FIGS. 3 and 4 lies in the interposition of a ceramic window 40 (vacuum tight, and transparent to high-frequency energy) between the grid connection and the coupling capacitance.

In FIG. 3, metal part 35 seals off in a fixed manner, the resonant cavity composed of the tube, making it impossible to change the dimensions of this cavity; this cavity can therefore be tuned only to a fixed frequency.

In FIG. 4, the high-energy cavity has been opened, while keeping it vacuum-tight thanks to window 40. It is therefore possible to connect this window to a portion of the primary resonant circuit, said portion being tunable and forming part of a coupled-cavity structure.

More specifically, the design can be as follows: the anode connection is precisely identical to that in FIG. 3 (references 30, 31, 32, 33, 34).

The grid connection comprises a supporting element 37 as in FIG. 3, made of copper; a cylinder 41 made of an alloy (kovar) is soldered to this flange and serves as an intermediary between part 37 and alumina window 40.

Window 40 has a flat annular disk made of alumina several mm thick (thick enough to allow it to be soldered at the edges). This disk is soldered by its inner edge to cylinder 41 and by its outer edge to an intermediate part made of a material (kovar) that can be soldered to alumina. Here, this intermediate part is composed of two parts 42 and 43 soldered together. Part 42 is soldered to window 40; part 43 is shaped so that it can be soldered on one side to part 42 and on the other side to dielectric ring 39 of the coupling capacitance. This ring 39 is located precisely as shown in FIG. 3, soldered by its flat faces between a projection 33 on anode connection 30 and part 43 opposite this projection. The dielectric ring is much larger than the projection to ensure sufficient voltage strength during flashover. Cylindrical periphery 34 of the anode connection projects outside dielectric ring 39.

Assembly 42, 43 also comprises at least one surface defining a cylinder against which an intermediate wall of a coupled capacity structure can abut.

The coupled-cavity structure wherein this tube is to be mounted is shown by the dashed lines in FIG. 4.

It comprises two resonant circuits, a primary circuit (at least a part of this circuit) and a secondary circuit, but no coupling means between these circuits since the coupling means are an integral part of the tube.

The primary circuit comprises firstly the portion of space under vacuum between the anode and grid (G2) as far as window 40; it further comprises a portion of the cavity forming part of the coupled-cavity structure; this portion of the cavity is delimited by two walls 21 and 22 and extends between window 40 and a conducting piston 25 serving to tune the primary circuit. Wall 21 is an intermediate wall of the coupled-cavity structure; it is in contact with intermediate part 42 located radially between support 37 for grid G2 and external periphery 34 of the anode connection. Wall 22 is an internal wall of the coupled-cavity structure; it abuts part 37 supporting grid G2.

The secondary circuit is delimited by intermediate wall 21 and an external wall 20 of the coupled-cavity structure; wall 20 is in contact with cylindrical periphery 34 of the anode connection. The resonant cavity of this secondary circuit is delimited by these walls and extends between the coupling means (the capacitance whose dielectric is alumina ring 39) and a conducting tuning piston 26.

The secondary cavity is provided with an energy extraction means 28.

It is very important to note here that with this tube design, ceramic window 40 is relatively remote from the space between the anode and the grid. The coupling means is closer to this space. Consequently, the voltage loss introduced by the capacitance of this window is relatively low and this capacitance therefore has very little effect on the total output capacitance of the tube; it very slightly increases the electrical dimension of the primary resonant cavity so that it is possible to obtain a maximum tube operating frequency greater than that obtained with the design shown in FIGS. 1 and 2.

Figure 5:
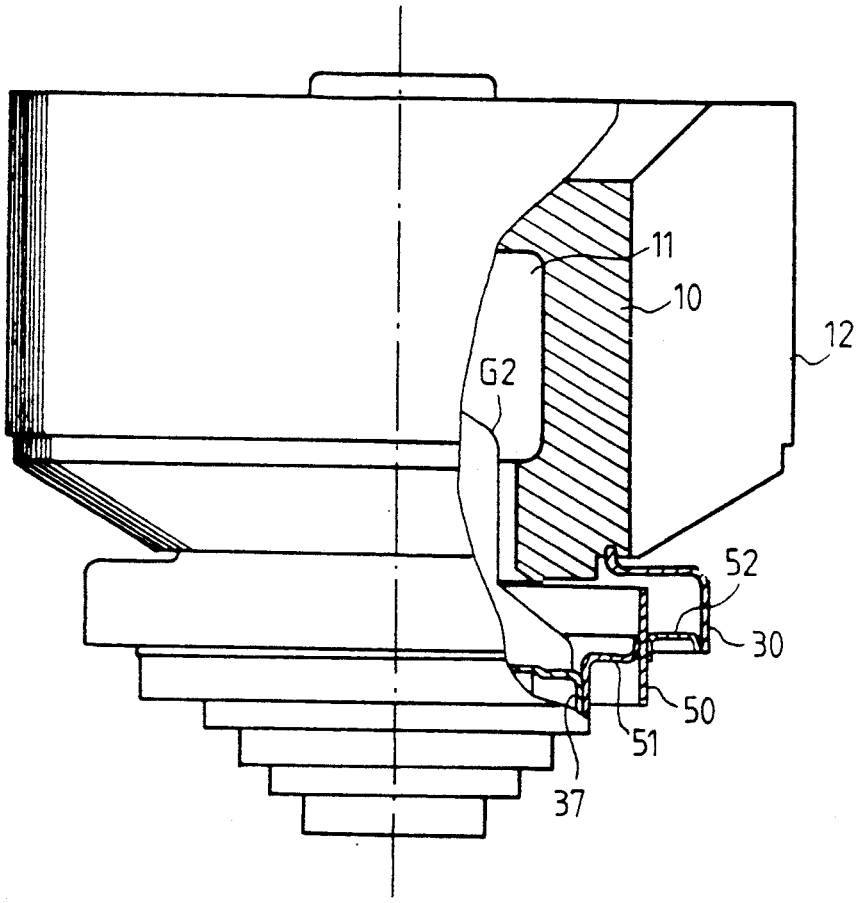
FIG. 5 shows a third embodiment of the invention.

FIG. 5 shows one embodiment. As in FIG. 3, the tube operates at a fixed frequency. But this time the coupling capacitance dielectric is not a flat ring but a cylinder 50 coaxial with the general axis of the tube. This cylinder is soldered between a conducting part 51 connected to the grid connection (more specifically to support 37 of the grid) and a conducting part 52 connected to anode connection 30. Parts 50, 51 and 52 ensure the following:

Vacuum tightness;

electrical insulation between anode and grid, and high-frequency energy coupling between a primary circuit (the interior of the tube) and a secondary circuit (a resonant cavity structure wherein the tube is mounted).

A variation of the diagram shown in FIG. 5 for operation at adjustable frequency can easily be effected in the same way as the transition from FIG. 3 to FIG. 4 by replacing the conducting closure (constituted by a part 51) by a tight window assembly made of alumina, facing a portion of the primary resonant cavity of a coupled-cavity structure. This assembly would include a part similar to part 41 in FIG. 4, a window analogous to window 40, and a part analogous to part 42 (or assembly 42, 43) soldered between the tight window and cylinder 50.

Figure 6:
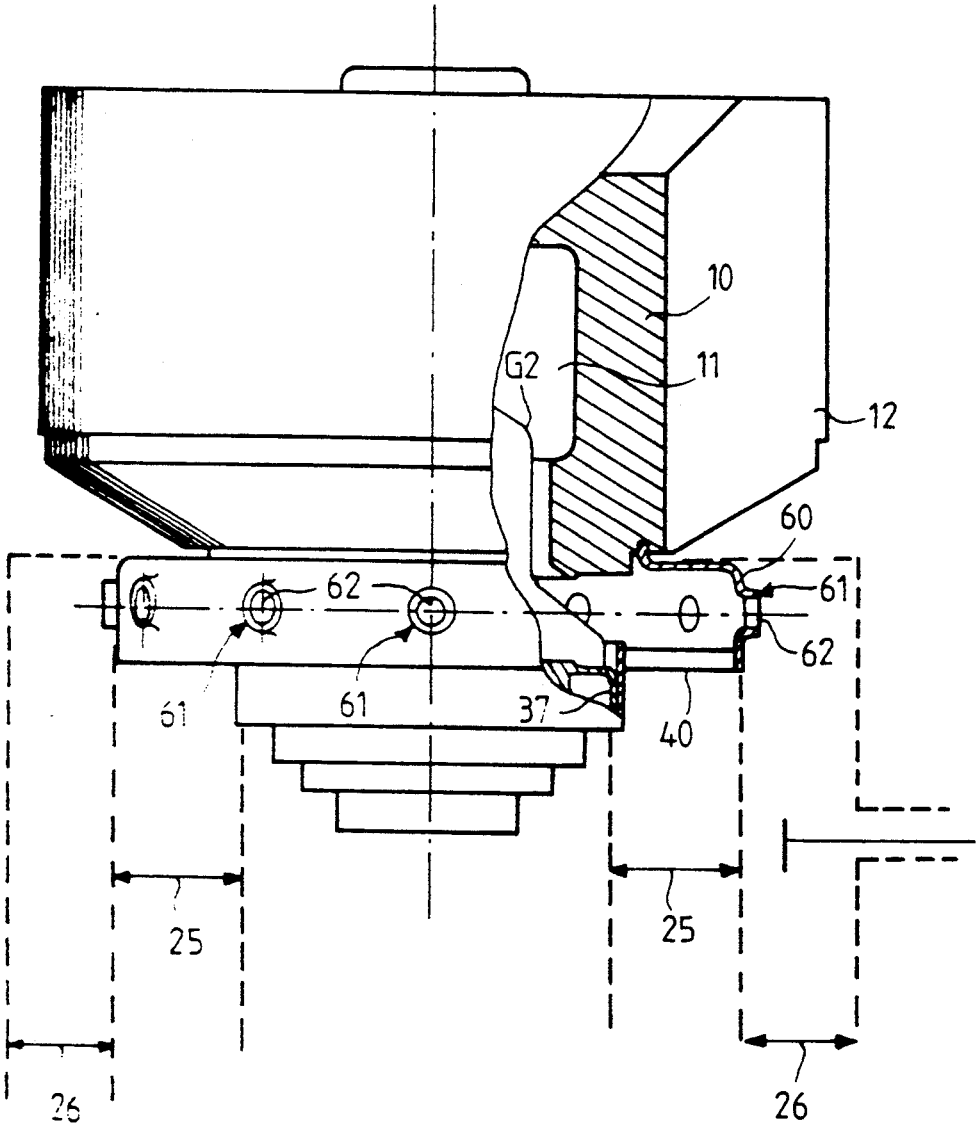
FIG. 6 shows a fourth embodiment, with inductive and noncapacitive coupling.

FIG. 6 shows a variation demonstrating that inductance-type coupling (coupling by the magnetic field) is possible by replacing the capacitive coupling. It involves a design allowing the tube to function at adjustable frequency.

The design takes its inspiration from that in FIG. 4. Grid connection G2 is connected to a tight window 40 designed to face a portion of the primary cavity whose frequency can be tuned when the tube is connected to a coupled-cavity structure.

The anode connection, electrically insulated from the grid connection by the entire width of window 40, is composed of a conducting cylindrical wall 60 pierced by small eyes 61 distributed all around this wall, each eye being closed by a vacuum-tight dielectric window 62. These eyes face a secondary cavity of the coupled-cavity structure wherein the tube will be mounted. The frequency of this cavity can be adjusted by a piston 26 (see FIG. 4). The primary cavity once again includes a portion comprising the space under the internal vacuum of the tube and an external portion, the latter being part of the coupled-cavity structure and tunable by a piston 25 as shown in FIG. 4. These two sections are separated from one another by vacuum-tight dielectric window 40.

As in FIG. 4, ceramic window 40 is further than the coupling means from the zone where the high-frequency fields are developed between the anode and the grid. It is therefore not a problem even though its capacitance is significant.

I claim:

1. A grid vacuum tube designed to be mounted on a resonant cavity structure to extract high frequency energy from the vacuum tube, said resonance cavity structure distinct from the tube, said vacuum tube comprising an evacuated space between an anode and a grid, said evacuated space forming at least a portion of a first resonant cavity when said vacuum tube is mounted on the resonance cavity structure, said resonance cavity structure comprising at least a second resonant cavity, and said second resonant cavity being electromagnetically coupled to said first resonant cavity by electromagnetical coupling means when said vacuum tube is mounted on said resonant cavity structure, wherein said electromagnetic coupling means are a part of the vacuum tube and are in the immediate vicinity of said evacuated space.

2. A vacuum tube according to claim 1, wherein said electromagnetic coupling means are adapted to establish a vacuum tightness of the tube where it is located.

3. A vacuum tube according to claim 1 or 2, wherein said electromagnetic coupling means consist in a capacitance made form a disk or cylinder in a dielectric material and soldered to metal parts, the dielectric material, the metal parts and a soldering material ensuring the vacuum tightness of the tube.

4. A vacuum tube according to claim 1 or 2, wherein said electromagnetic coupling means consist of an inductive coupling means such as a conducting cylinder pierced by small vacuum-tight windows.

5. A vacuum tube according to claim 1 or 2, wherein said electromagnetic coupling means are located between an anode connection designed to come in contact with a first conducting wall of the resonant cavity structure and a metal part designed to come in contact with a second conducting wall of said resonance cavity structure.

6. A vacuum tube according to claim 5, wherein said metal part designed to contact the second conducting wall is electrically connected to a grid connection of the tube.

7. A vacuum tube according to claim 5, wherein said metal part designed to come in contact with the second conducting wall is an intermediate part and wherein a vacuum-tight dielectric window is mounted between this intermediate part and a grid connection which is designed to come in contact with a third conducting wall of the resonant cavity structure.

8. A vacuum tube according to claim 7, wherein said dielectric window is located further from an electron interaction space between the grid and anode than said electromagnetic coupling means.

9. A vacuum tube according to claim 1 or 2, wherein the tube comprises a cylindrical flange for connecting the anode and allowing said anode to be connected to an outside wall of the resonant cavity structure; a flat ceramic ring comprising a dielectric for the electromagnetic coupling means, the latter being of capacitive type, the ring having flat faces soldered both to this cylindrical flange and to an intermediate conducting flange permitting connection to an intermediate wall of the resonant cavity structure.

* * * * *